US005587280A

United States Patent [19]

Ikeda et al.

[11] Patent Number: 5,587,280

[45] Date of Patent: Dec. 24, 1996

[54] LIGHT-SENSITIVE SILVER HALIDE EMULSION AND PHOTOGRAPHIC LIGHT-SENSITIVE MATERIAL USING THE SAME

[75] Inventors: Hideo Ikeda; Sadanobu Shuto; Takefumi Hara, all of Minami-ashigara, Japan

[73] Assignee: Fuji Photo Film Co., Ltd., Kanagawa, Japan

[21] Appl. No.: 444,677

[22] Filed: May 19, 1995

Related U.S. Application Data

[63] Continuation of Ser. No. 195,438, Feb. 14, 1994, abandoned.

[30] Foreign Application Priority Data

Feb. 12, 1993 [JP] Japan ..... 5-046162

[51] Int. Cl.$^6$ ..... G03C 1/035

[52] U.S. Cl. ..... 430/567; 430/637

[58] Field of Search ..... 430/567, 637

[56] References Cited

U.S. PATENT DOCUMENTS

| | | | |
|---|---|---|---|
| 5,147,771 | 9/1992 | Tsaur et al. | 430/567 |
| 5,147,773 | 9/1992 | Tsaur et al. | 430/567 |
| 5,171,659 | 12/1992 | Tsaur et al. | 430/567 |
| 5,217,858 | 6/1993 | Maskasky | 430/567 |
| 5,219,720 | 6/1993 | Black et al. | 430/567 |

*Primary Examiner*—Janet C. Baxter
*Attorney, Agent, or Firm*—Birch, Stewart, Kolasch & Birch, LLP

[57] ABSTRACT

A light-sensitive silver halide emulsion contains tabular silver halide grains with an equivalent-circle diameter/thickness ratio of 8 to 100. In this light-sensitive silver halide emulsion, a variation coefficient of a grain size distribution of the tabular silver halide grains is 1% to 20%, and 50% or more (number) of all of the tabular silver halide grains are grains whose ratio, b/a, of a longest distance, a, between two or more twin planes of the tabular silver halide grain to a grain thickness, b, is $1.5 \leqq b/a < 5$.

9 Claims, No Drawings

LIGHT-SENSITIVE SILVER HALIDE EMULSION AND PHOTOGRAPHIC LIGHT-SENSITIVE MATERIAL USING THE SAME

This application is a continuation of application Ser. No. 08/195,438 filed on Feb. 14, 1994, now abandoned.

BACKGROUND OF THE INVENTION

1. Field of the Invention

The present invention relates to a light-sensitive silver halide emulsion and a photographic light-sensitive material which have high-gamma photographic characteristics, a good graininess, a high incubation resistance, and a high latent image stability.

2. Description of the Related Art

Methods of manufacturing and techniques of using tabular silver halide grains are disclosed in, e.g., U.S. Pat. Nos. 4,434,226, 4,439,520, 4,414,310, 4,433,048, 4,414,306, and 4,459,353, JP-A-59-994335 ("JP-A" means Unexamined Published Japanese Patent Application), JP-A-60-209445, and JP-A-63-151618. Known advantages of grains of this type are improvements in sensitivity including an improvement in spectral sensitization efficiency obtained by sensitizing dyes, a good sensitivity/graininess relationship, and an improvement in sharpness and in covering power derived from specific optical properties of tabular grains.

In addition, EP514,742A describes that an emulsion, in which a value (flatness) obtained by dividing the value of a mean equivalent-circle diameter by the square of a mean thickness is 8 or greater, and which has mono-dispersity by which the standard deviation of a grain size distribution is 10% or less, has high-gamma photographic properties and a good graininess.

The present inventors have examined emulsions with the above characteristics and found that they require further improvements in incubation resistance and latent image stability.

SUMMARY OF THE INVENTION

It is an object of the present invention to provide a light-sensitive silver halide emulsion and a photographic light-sensitive material which have high-gamma photographic characteristics, a good graininess, a high incubation resistance, and a high latent image stability.

The above object of the present invention has been achieved by a light-sensitive silver halide emulsion containing tabular silver halide grains with an equivalent-circle diameter/thickness ratio of 8 to 100, wherein a variation coefficient of a grain size distribution of said tabular silver halide grains is 1% to 20%, and 50% by number or more of all of said tabular silver halide grains are grains whose ratio, b/a, of a longest distance, a, between two or more twin planes of said tabular silver halide grain to a grain thickness, b, is $1.5 \leqq b/a < 5$.

A photographic light-sensitive material of the invention has at least one silver halide emulsion layer on a support, and comprises at least one emulsion layer consisting of the emulsion of the invention is also provided.

DETAILED DESCRIPTION OF THE PREFERRED EMBODIMENTS

The present invention will be described in detail below.

In the present invention, a tabular silver halide grain (to be referred to as a "tabular grain" hereinafter) refers to a silver halide grain which has two opposing parallel major faces and in which the equivalent-circle diameter (the diameter of a circle having the same projected area as that of the major face) of the major face is at least twice as large as the distance (the thickness of the grain) between the major faces.

In the present invention, the aspect ratio of a grain is defined as a value obtained by dividing the equivalent-circle diameter of a grain by the thickness of that grain both of which are obtained by the method described later.

The aspect ratio of an emulsion containing the tabular grains of the present invention is 8 to 100, preferably 12 or more, and particularly preferably 14 or more.

The (equivalent-circle) diameter of the tabular grains of the present invention is generally 0.2 to 5.0 μm, preferably 0.3 to 4.0 μm, and more preferably 0.3to 3.0μm.

The grain thickness is generally 0.5 μm or less, preferably 0.03 to 0.5 μm, and more preferably 0.05 to 0.3 μm.

The grain diameter and the grain thickness in the present invention can be measured from electron micrographs of grains as in the method described in U.S. Pat. No. 4,434,226.

The tabular grains of the present invention are characterized by their monodispersity by which the variation coefficient of a grain size distribution is 1% to 20%, preferably 10% or less. In this case, the variation coefficient is represented by a "value obtained by dividing a variation (standard deviation) of grain sizes, which are obtained from the equivalent-circle diameters of the projected areas of tabular grains and the thicknesses of the grains, by a mean grain size and multiplying the quotient by 100." A grain size, R (μm), is calculated from an equivalent-circle diameter, r (μm), of a projected area and a thickness, d (μm), in accordance with the following relation.

$$R=(3r^2d/2)^{1/3}$$

The grain size distribution of a silver halide emulsion consisting of silver halide grains having a uniform grain shape and a small grain size variation exhibits a nearly normal distribution, so a standard deviation can be calculated easily. The variation coefficient of the grain size distribution of the tabular grains of the present invention is 20% or less, preferably 10% or less, more preferably 8% or less, and most preferably 5% or less.

A grain size, b, is the distance between parallel outer surfaces. Measurement of the grain thickness can be easily performed by obliquely depositing a metal together with a latex as a reference on a grain, measuring the length of its shadow on an electron micrograph, and calculating the grain thickness with reference to the length of the shadow.

A method of measuring a spacing, a, of twin planes of the silver halide grain of the present invention will be described below.

The spacing, a, of twin planes is the distance between two twin planes in the case of a grain having two twin planes inside the grain. In the case of a grain having three or more twin planes, the spacing, a, of twin planes is the longest one of the distances between these twin planes.

A twin plane is a (111) plane if ions at all lattice points on the both sides of this (111) plane have a mirror-image relationship.

Observation of twin planes can be done by use of a transmission electron microscope.

More specifically, an emulsion consisting of tabular grains is coated on a support to form a sample in which the tabular grains are arranged nearly parallel to the support. The resultant sample is cut into a sample piece with a thickness of about 0.1 μm by using a diamond knife.

Twin planes of the tabular grains can be found by observing this sample piece by using a transmission electron microscope.

The existence of a twin plane is found because a phase difference is produced in an electron wave when an electron beam passes through the twin plane.

Although the thickness of a twin plane of a tabular grain can be estimated in accordance with the method disclosed in J. F. Hamilton and L. F. Brady et al., J. Appl. Phys. 35, pages 414 to 421 (1964), the use of the above method is easier.

In the present invention, tabular grains whose value of b/a is 1.5 to smaller than 5 account for 50% or more, preferably 70% or more, and most preferably 90% or more of the number of all tabular grains. It is particularly preferable that tabular grains whose value of b/a is 1.5 to 2.5 account for 50% or more, preferably 70% or more, and most preferably 90% or more of the number of all tabular grains.

It is also preferable that the variation coefficient of the grain thickness, b, be 20% or less, the variation coefficient of the value of b/a be 20% or less, and the variation coefficient of the projected area of a tabular grain be 30% or less.

The variation coefficient of the thickness, b, is obtained by dividing the standard deviation of the thicknesses, b, by the mean of the thicknesses, b, and multiplying the quotient by 100. The variation coefficient of b/a and that of the projected area are defined in the same manner.

The tabular grain of the present invention may contain dislocations.

Dislocations can be observed by a direct method performed at low temperatures using a transmission electron microscope, as described in, for example, J. F. Hamilton, Phot. Sci. Eng., 11, 57, (1967) or T. Shiozawa, J. Soc. Phot. Sci. Japan, 35, 213, (1972). That is, silver halide grains are carefully extracted from an emulsion so as not to produce a pressure by which dislocations are formed in the grains, and are placed on a mesh for electron microscopic observation. The sample is observed by a transmission method while being cooled to prevent damages (e.g., print out) caused by electron rays. In this case, as the thickness of a grain is increased, it becomes more difficult to transmit electron rays through it. Therefore, grains can be observed more clearly by using an electron microscope of a high voltage type (200 kV or higher for a grain having a thickness of 0.25 μm). Photographs of grains obtained by this method show the positions and the number of dislocations in each grain viewed in a direction perpendicular to the major faces.

In the tabular grain of the present invention, dislocations are produced along the major axis direction of the tabular grain in a region from each edge to an x% position (start position of a dislocation line) of the length from the center to the edge. The dislocation line extend from the start position to an edge of the grain. The value of x is preferably $10 \leqq x < 100$, more preferably $30 \leqq x < 98$, and most preferably $50 \leqq x < 95$. In this case, although a shape obtained by connecting the start positions of the dislocations is almost similar to the shape of the grain, it is not perfectly similar but distorted in some cases. The direction of dislocation lines is mostly from the center to the edges but is often zigzagged.

In the present invention, tabular grains having 10 or more dislocations are preferably present at a ratio of 50% (number) or more based on all tabular grains. More preferably, tabular grains having 10 or more dislocations are present at a ratio of 70% (number) or more. Most preferably, grains having 10 or more dislocations are present at a ratio of 90% (number) or more.

In the tabular grains of the present invention, the variation coefficient of the silver iodide content distribution of individual grains is preferably 30% or less, and more preferably 20% or less.

The silver iodide contents of individual emulsion grains can be measured by analyzing the composition of each grain by use of, e.g., an X-ray microanalyzer. The "variation coefficient of the silver iodide contents of individual grains" can be obtained by measuring the silver iodide contents of at least 100 emulsion grains by using, e.g., an X-ray microanalyzer, dividing the standard deviation of the silver iodide contents measured by a mean silver iodide content, and multiplying the quotient by 100. A specific method of measuring the silver iodide contents of individual emulsion grains is described in, e.g., EP147,868A.

In the present invention, grains whose silver iodide contents are measured to obtain the variation coefficient of their silver iodide content distribution are large-size tabular silver halide grains defined as follows. That is, when all grains of an emulsion are arranged in decreasing order of a projected area and their projected areas are added, the "large-size tabular silver halide grains" are grains obtained when the sum reaches 50% of the total projected area. To actually obtain the variation coefficient, it is necessary to check whether each of 500 or more grains extracted at random is the large-size tabular silver halide grain as a control, and to measure the silver iodide contents of the 500 or more grains which are extracted at random from grains as a control. If, therefore, fine grains with extremely different silver iodide contents are present, these silver iodide contents are neglected in calculating the variation coefficient.

If the variation coefficient of the silver iodide content distribution of individual grains is large, adequate points of chemical sensitization (conditions of chemical sensitization adequate for individual grains) are different between the grains. This makes it impossible to take advantage of performance of all emulsion grains.

Although grains have or do not have a correlation between a silver iodide content Yi (mol %) and a grain size Xi (μm), it is possible to use both of them.

A structure concerning the halogen composition of a grain can be confirmed by combining X-ray diffraction, an EPMA (also called XMA) method (a method of scanning a silver halide grain by electron rays to detect its silver halide composition), and an ESCA (also called XPS) method (a method of radiating X-rays to spectroscopically detect photoelectrons emitted from the surface of a grain).

A method of manufacturing the tabular grains of the present invention will be described below.

As the tabular grain manufacturing method, it is possible to use a given combination of methods known to those skilled in the art.

The silver halide emulsion of the present invention can be manufactured by either of the following methods.

(1) Nucleation→ripening (2) Nucleation→ripening→growth

Steps of nucleation, ripening, and growth, therefore, as the basic steps of both the methods will be described below.

1. Nucleation

Nucleation is performed at a pBr of 1.0 to 2.5 by using gelatin as a dispersing medium. The pBr can be controlled by a silver potential in any of the nucleation, ripening, and growth steps.

A low-molecular-weight gelatin can be used as the gelatin. The average molecular weight of the gelatin is preferably 60,000 or less, and more preferably 1,000 to 40,000. If an average molecular weight is greater than 60,000, the ratio of tabular grains in all silver halide grains tends to decrease.

The low-molecular-weight gelatin can be used in an amount of 50% by weight or more, preferably 70% by weight or more of the dispersing medium.

The concentration of the dispersing medium can be 0.05 to 10% by weight.

Alkali-processed gelatin is commonly used as the gelatin, but it is also possible to use acid-processed gelatin or modified gelatin such as phthalated gelatin.

In addition, one or both of an aqueous $AgNO_3$ solution and an aqueous alkali halide solution which are added during nucleation can contain gelatin. The low-molecular-weight gelatin described above can be used as this gelatin. As in the above case, the low molecular weight gelatin can be used in an amount of 50 wt % or more, preferably 70 wt % or more of the dispersing medium.

The concentration of the dispersing medium in this case is preferably 0.05 to 5 wt %, and more preferably 0.3 to 2.0 wt %.

It is assumed that the effect that the low molecular weight gelatin increase the ratio of the tabular grains is obtained by avoiding a nonuniform gelatin concentration near an addition port of the aqueous $AgNO_3$ solution and the aqueous halide salt solution, thereby preventing formation of multi-twinning grains.

A frequency at which twin planes are formed during nucleation depends on various supersaturation factors (e.g., a temperature during nucleation, a gelatin concentration, the type of gelatin, the molecular weight of gelatin, the addition rates of an aqueous silver salt solution and an aqueous alkali halide solution, a $Br^-$ concentration, the rotating speed of stirring, the $I^-$ content of an aqueous alkali halide solution to be added, the amount of a silver halide solvent, a pH, salt concentrations (e.g., the concentrations of $KNO_3$ and $NANO_3$), and the concentrations of an emulsion stabilizer, an antifoggant, and a sensitizing dye). This dependency is shown in FIG. X of JP-A-63-092942.

If these supersaturation factors are increased during nucleation in a method in which the nucleation is performed at a low temperature (25° to 30° C.) and high supersaturation growth is immediately performed at the low temperature without performing ripening, principal grains formed change in an order of a) octahedral regular grains→b) grains having a single twin plane→c) grains (object) having two parallel twin planes→d) grains having nonparallel twin planes→e) grains having three or more twin planes.

In the present invention, therefore, it is favorable to perform nucleation such that the formation probability of the grains c) is increased as high as possible within a range over which the formation ratio of the grains d) or e) is not increased.

That is, the above various supersaturation factors are adjusted such that the presence ratio of the grains c) falls within a range defined by the present invention in a silver halide emulsion finally obtained by the grain formation method of the present invention while the dependency shown in the figure of JP-A-63-092942 mentioned earlier is checked. More specifically, the conditions of the above supersaturation factors during nucleation are adjusted while replica images of finally produced silver halide grains are observed by a transmission electron microscope.

When tabular grains finally obtained by adjusting these various factors were observed, it was found that the mixing ratio of nontabular grains was low in the tabular grains formed by performing nucleation under the above conditions compared to grains obtained when a regular photographic gelatin with an average molecular weight of 100,000 was used as a dispersing medium. As for the shapes of grains, the ratio of hexagonal tabular grains described in JP-A-63-151618 is high. In grains according to the Example of French Patent 2,534,036, the ratio of triangular tabular grains (having three parallel twin planes) is high. The reason for this is assumed that nucleation was performed in a high supersaturation condition.

Other preferred conditions during nucleation according to the present invention are as follows.

Although the temperature can be 5° to 60° C., it is preferably 5° to 48° C. in forming fine tabular grains with a mean grain size of 0.5 μm or less. The addition rate of $AgNO_3$ is preferably 0.5 to 30 g/min per liter of an aqueous reaction solution.

A dispersing medium in a reactor vessel initially does not essentially contain iodide ions. This is so because if iodide ions are present before simultaneous addition of silver and bromide salts, thick nontabular grains readily form, and, even in the case of tabular grains, spacings of twin planes are nonuniform and the distribution of b/a values is broadened when the grains are observed by an observation method to be described later. In this case, "not essentially containing iodide ions" means that iodide ions exist in only an amount insufficient to precipitate as another silver iodide phase as compared with bromide ions. It is desirable that an iodide concentration in a reactor vessel before a silver salt is introduced be kept at less than 0.5 mol % of a total halide ion concentration in the reactor vessel. If the pBr of the dispersing medium is initially too low, tabular silver iodobromide grains become relatively thin, and this broadens the grain size distribution or the b/a distribution. If the pBr is too high, on the other hand, nontabular grains readily form. The present inventors have made studies by observing spacings of twin planes of tabular silver iodobromide grains and found that the distribution of the thicknesses and the distribution of the values of b/a are narrowed by maintaining the pBr in the reactor vessel at 1.0 to less than 2.5, preferably 1.1 to less than 1.8. The pBr in this case is defined by a negative value of the logarithm of a bromide ion concentration.

The concentration of an unrelated salt (a salt which does not directly participate in formation of a silver halide) in a reaction solution is preferably 0 to 1 mol/liter. The pH of the reaction solution can be 2 to 10, but it is preferably 8.0 to 10 if reduction-sensitized silver nuclei are to be introduced.

In the present invention, polyalkylene oxide block copolymers described in U.S. Pat. Nos. 5,147,771, 5,147,772, and 5,147,773 and EP513,723A are preferably used in order to increase the monodispersity.

Of these block copolymers, a particularly useful one is a polymer having in its molecule a block polymer component consisting of a hydrophobic polyalkylene oxide represented by Formula (I) below and a block polymer component consisting of a hydrophilic polyalkylene oxide represented by Formula (II) below.

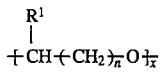

Formula (I)

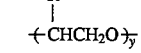

Formula (II)

wherein $R^1$ represents a hydrogen atom, an alkyl group having 1 to 10 carbon atoms (e.g., methyl, chloromethyl, ethyl, and n-butyl), or an aryl group having 6 to 10 carbon atoms (e.g., phenyl and naphthyl), and n represents an integer from 1 to 10. If n=1, $R^1$ is not a hydrogen atom.

$R^2$ represents a hydrogen atom or a lower alkyl group which is substituted with a hydrophilic group (e.g., hydroxy and carboxyl) and has 4 or less carbon atoms (e.g., hydroxymethyl and carboxymethyl).

Each of x and y represents the repeating number (number-average polymerization degree) of each unit.

Although favorable ranges of x and y vary depending on the structure of a polymer, x is preferably 2 to 1,000, and more preferably 3 to 500, and y is preferably 1 to 1,000, and more preferably 2 to 400.

The ratio of the component represented by Formula (I) to the component represented by Formula (II) in the block polymer can vary depending on the hydrophilic or hydrophobic nature of each unit and the type of an emulsion. However, the ratio roughly ranges between 4:96 and 96:4 as a weight ratio.

A hydrophobic polyalkylene oxide represented by Formula (I) is particularly preferably polypropylene oxide ($R^1$= methyl, n=1). A hydrophilic polyalkylene oxide represented by Formula (II) is preferably polyethylene oxide ($R^2$= hydrogen atom) or polyglycerol ($R^2$=$CH_2OH$), and particularly preferably polyethylene oxide.

As the polymer having the above block copolymer components in its molecule, a compound having, as its block copolymer components, polypropylene oxide-polyethylene oxide as representative components will be described in more detail below.

Representative examples of the polymer used in the present invention are those represented by Formulas (III) to (X) below.

In Formulas (III) to (X), each of x, x', x", x"', y, y', y", and y"' represents the repeating number of each unit, and their preferable ranges are identical with those of x and y of Formulas (I) and (II). $R^3$ represents a monovalent group. More specifically, $R^3$ represents a hydrogen atom, a substituted or unsubstituted alkyl group or aryl group, preferably a substituted or unsubstituted lower alkyl group (having 6 or less carbon atoms). Examples of $R^3$ are methyl, ethyl, n-propyl, isopropyl, t-butyl, chloromethyl, methoxycarbonylmethyl, N-methyl-N-ethylaminoethyl, and N,N-diethylaminoethyl.

In Formulas (VII) to (X), L represents a trivalent or tetravalent linking group. Examples of L are presented below, but L is not limited to these examples.

Formula (II)

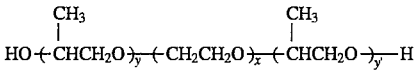

Formula (IV)

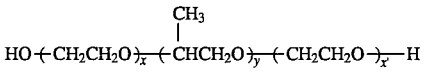

Formula (V)

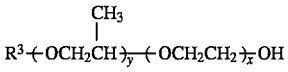

Formula (VI)

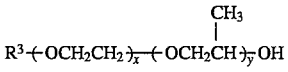

Formula (VII)

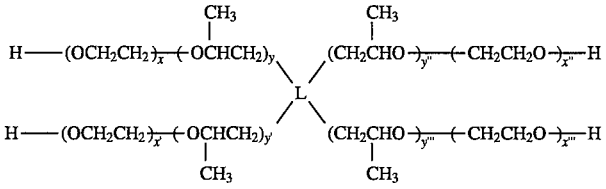

Formula (VIII)

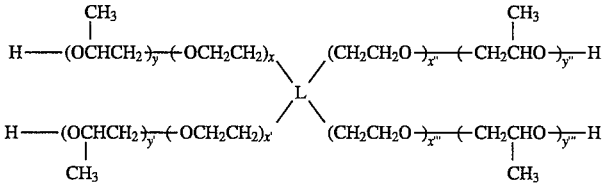

Formula (IX)

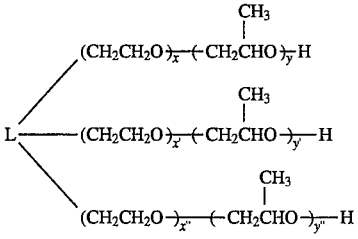

Formula (X)

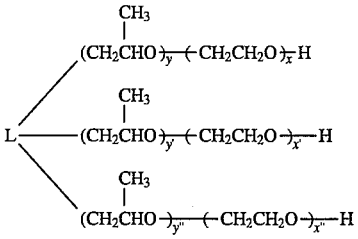

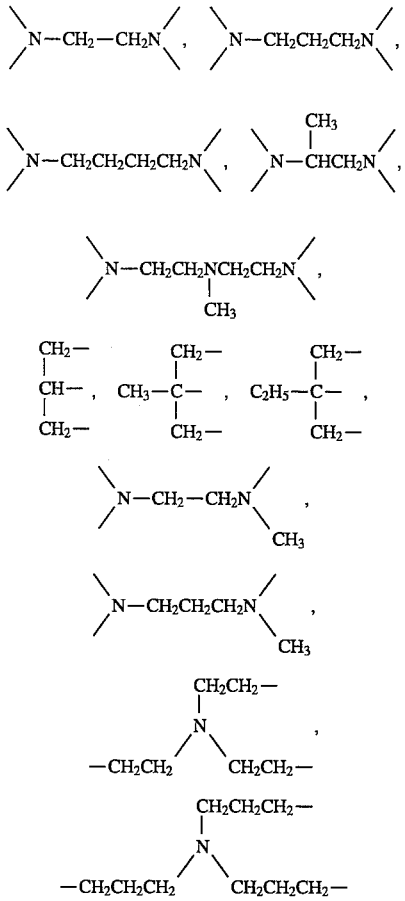

Examples of the polymer having the block polymer components in its molecule for use in the present invention are listed in Tables 1 and 2 below, but the present invention is not limited to these examples.

TABLE 1

| Compound No. | Type of polymer (number of formula) | $R^3$ | x | y |
|---|---|---|---|---|
| P-1 | (III) | | 7 | 25 |
| P-2 | (III) | | 5 | 15 |
| P-3 | (III) | | 27 | 15 |
| P-4 | (III) | | 125 | 23 |
| P-5 | (III) | | 42 | 23 |
| P-6 | (III) | | 16 | 23 |
| P-7 | (IV) | | 10 | 15 |
| P-8 | (IV) | | 40 | 15 |
| P-9 | (IV) | | 2 | 32 |
| P-10 | (IV) | | 9 | 32 |
| P-11 | (IV) | | 20 | 32 |
| P-12 | (IV) | | 135 | 50 |
| P-13 | (IV) | | 14 | 50 |
| P-14 | (V) | $CH_3$— | 35 | 30 |
| P-15 | (V) | $C_3H_7$— | 25 | 50 |
| P-16 | (V) | $C_2H_5$— | 20 | 70 |
| P-17 | (VI) | $CH_3$— | 40 | 25 |
| P-18 | (VI) | $(CH_3)_2CH$— | 50 | 30 |

y' of an exemplified compound represented by Formula (II) has the same value as y.
x' of an exemplified compound represented by Formula (III) has the same value as x.

TABLE 2

| Compound No. | Type of polymer (number of formula) | L | x | y |
|---|---|---|---|---|
| P-19 | (VII) |  | 2 | 15 |
| P-20 | (VII) | | 16 | 17 |
| P-21 | (VII) | | 4 | 32 |
| P-22 | (VII) | | 140 | 32 |
| P-23 | (VIII) | | 18 | 20 |
| P-24 | (VIII) | | 4 | 33 |
| P-25 | (VIII) | | 108 | 20 |
| P-26 | (VI) | 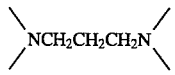 | 15 | 20 |
| P-27 | (IX) | 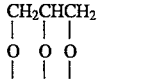 | 10 | 25 |
| P-28 | (IX) | | 40 | 20 |
| P-29 | (X) | 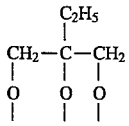 | 15 | 17 |
| P-30 | (X) | | 85 | 33 |
| P-31 | (IX) | 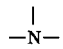 | 16 | 23 |
| P-32 | (X) | | 25 | 20 |
| P-33 | (X) | | 55 | 30 |

Each of x', x", and x"' and each of y', y", and y"' in each formula take the same values as x and y of each corresponding exemplified compound.

Examples and general description of the polymer used in the present invention, and examples of preparation of silver halide emulsions using the polymer of this type are given in, e.g., European Patents 513,722, 513,723, 513,724, 513,725, 513,742, 513,743, and 518,066.

2. Ripening

In the nucleation (item 1 above), although fine tabular grain nuclei are formed, a large number of other fine grains (especially octahedral and single-twinned grains) are formed simultaneously. It is therefore required to vanish grains other than tabular grain nuclei before a growth step to be described next is started, thereby obtaining nuclei having a shape as a tabular grain and a high monodispersity. Ostwald ripening is performed subsequently to the nucleation in order to make this possible.

Although the method described in JP-A-63-151618 is usable as this ripening method, the following method is particularly effective.

After nucleation, a portion of the resultant emulsion is extracted as a seed crystal and added with an aqueous gelatin solution, or, an aqueous gelation solution is simply added after nucleation, thereby controlling the pBr and the gelation concentration. In this case, the pBr is preferably low (1.4 to 2.0), and the gelation concentration is 1 to 10% by weight. The gelatin is preferably one having an average molecular weight of 80,000 to 300,000, normally 100,000, which is often used in the field of photography.

Subsequently, when the temperature is raised to cause first ripening, tabular grains grow, and nontabular grains disappear. Second ripening is then started by adding a silver halide solvent. The concentration of the silver halide solvent in this case is preferably $1\times10^{-4}$ to $2\times10^{-1}$ mol/liter. The value of b/a can be increased by increasing the concentration of the silver halide solvent. Ripening is performed in this manner to obtain nearly 100% tabular grains.

In this ripening step, as in the above nucleation step, the polyalkylene oxide block copolymer described above can be preferably used.

In the first ripening at a low pBr, basically Ostwald ripening between twinned grains having troughs and grains having no troughs takes place. In the next second ripening using a silver halide solvent, Ostwald ripening occurs between the major faces of tabular grains and the spherical surfaces of nontabular grains, resulting in almost 100% tabular grains.

This second ripening has an effect of vanishing nontabular grains that cannot be vanished in the first ripening, and an effect of obtaining a uniform thickness of seed crystals of tabular grains. When ripening is done at a low pAg by using a silver halide solvent, growth is caused in the direction of thickness of tabular grains, and this increases the thicknesses of the grains. If the grain thicknesses are nonuniform, growth rates in the lateral direction become nonuniform in the crystal growth performed next. This phenomenon is significant especially during crystal growth under a low pBr (1.4 to 2.0) condition, and hence is unpreferred particularly in such a case.

Since the ripening proceeds slowly at low temperatures, it is performed at 40° C. to 80° C., preferably 50° C. to 80° C. in a practical point of view.

The gelatin concentration is 0.05 to 10% by weight, preferably 1.0 to 5.0% by weight. In an emulsion at the end of this ripening step, 95% or more of the total projected area of all silver halide grains are accounted for by tabular grains having two parallel twin planes. Normally, these tabular grains are hexagonal tabular grains in which the corners of a hexagon are slightly rounded, or circular tabular grains.

When this ripening step is finished, the resultant emulsion may be washed with water by a regular washing process and used as the tabular grains of the present invention.

When the ripening is finished, however, a crystal growth step is normally started in order to grow the crystal to have a desired size.

After the ripening, the silver halide solvent is removed as follows if it is unnecessary in the next growth step.

(1) An emulsion is washed with water.

As the emulsion washing process, it is possible to use conventional methods, such as (i) a noodle washing method, (ii) a washing method of causing precipitation by adding a precipitating agent, (iii) a precipitation washing method using a modified gelatin such as gelatin phthalate, and (iv) an ultrafiltration method (described in detail in G. F. Duffin, "Photographic Emulsion Chemistry," Focal Press, London, 1966 and references to be presented later).

(2) In the case of an alkaline silver halide solvent such as $NH_3$, an acid such as $HNO_3$ having a large solubility product with respect to $Ag^+$ is added to neutralize the silver halide solvent, thereby rendering the solvent ineffective.

(3) In the case of a thioether-based silver halide solvent, an oxidizing agent such as $H_2O_2$ is added to render the solvent ineffective as described in JP-A-60-136736.

3. Growth

In a crystal growth period subsequent to the ripening step, the pBr is preferably kept at 1.4 to 3.0. It is also preferable to set the addition rates of $Ag^+$ and halogen ions in the crystal growth period at 20% to 100%, preferably 30% to 100% of a crystal critical growth rate.

That is, as the pBr and the supersaturation degree are increased in a growth environment during the crystal growth period, tabular grains become more monodisperse with growth. However, on a high-pBr side (pBr 2 to 3.0, or in a tetradecahedral crystal or cubic crystal formation region to be described later), monodisperse tabular grains with a low aspect ratio are obtained since growth also occurs in the direction of thickness.

Tabular grains with a high aspect ratio can be obtained when growth is performed on a low-pBr side (pBr 1.4 to 2.0, or in a formation region of a {111}-face crystal such as an octahedral crystal to be described later) and at a high supersaturation.

In this case, the addition rates of silver ions and halogen ions are increased with the crystal growth. As a method of increasing the addition rates, it is possible to increase the addition rates (flow rates) of an aqueous silver salt solution and an aqueous halogen salt solution with fixed concentrations, or to increase the concentrations of the aqueous silver salt solution and the aqueous halogen salt solution, as described in JP-B-48-36890 ("JP-B" means Examined Published Japanese Patent Application) and JP-B-52-16364. It is also possible to increase the addition rate of a very-fine-grain emulsion with a grain size of 0.10 μm or less which is prepared beforehand. A combination of these methods is also possible. The addition rates of silver ions and halogen ions can be increased either intermittently or continuously.

The details of the addition rate increasing methods and stirring methods are described in JP-A-55-142329, Japanese Patent Application No. 61-299155, U.S. Pat. No. 3,650,757, and British Patent 1,335,925.

Generally, as the pBr of the growth environment is lowered and the supersaturation degree is decreased, the grain size distribution of resultant grains is broadened.

The use of the above-mentioned polyalkylene oxide block copolymer in this growth step is favorable to obtain monodispersity.

It is basically possible to prepare the tabular grains of the present invention through the steps of nucleation, ripening, and growth described above. However, the rotating speed of stirring and the shape of a reactor vessel in each step also have influences on the grain size distribution and the b/a distribution.

As a stirring and mixing apparatus, it is preferable to use an apparatus for adding and mixing a reaction solution into a solution such as described in U.S. Pat. No. 3,785,777. The rotating speed of stirring is preferably neither too low nor too high. If the rotating speed of stirring is low, the formation ratio of nonparallel twinned grains increases. If the rotating speed of stirring is too high, the formation frequency of tabular grains decreases, and the size distribution of the grains also broadens.

A reactor vessel most preferably has a semicircular bottom.

The halogen composition of a silver halide to be stacked on a nucleus during growth is not particularly limited. In many cases, the silver halide is AgBr or AgBrClI (a silver iodide content is 0 to a solid solution limit, and a Cl content is 0 to 50 mol %).

To obtain a gradually increasing or decreasing intragrain iodide distribution, it is possible to gradually increase or decrease the composition ratio of iodide in a halide to be added with crystal growth. To obtain a sharp distribution, it is possible to abruptly increase or decrease the composition ratio of iodide in a halide to be added with crystal growth.

As a method of supplying iodide ions during this crystal growth period, it is possible to use a method of adding a fine-grain AgI (grain size 0.1 μm or less, preferably 0.06 μm or less) emulsion prepared beforehand. This method also can be used in combination with a method of supplying iodide ions by using an aqueous alkali halide solution. The combination of these methods is particularly preferred because fine-grain AgI dissolves to uniformly supply $I^-$.

In the present invention, a reduction sensitization nucleus is preferably contained in the silver halide grain, and the pH of a solution during growth is preferably 8.0 to 9.5 in this point of view.

A silver halide solvent (to be described later) can be used to promote growth during the crystal growth period. The concentration of the silver halide solvent in that case is preferably $1\times10^{-4}$ to $2.0\times10^{-1}$ mol/liter.

Formation of dislocations in the tabular grain of the present invention can be controlled by forming a specific iodide-rich phase inside the grain. More specifically, substrate grains are prepared, and then an iodide-rich phase is formed and covered with a phase having an iodide content lower than that of the iodide-rich phase. In order for the silver iodide contents of individual grains to be uniform, it is important to properly select the formation conditions of the iodide-rich phase.

The internal iodide-rich phase is a silver halide solid solution containing iodide. This silver halide is preferably silver iodide, silver iodobromide, or silver bromochloroiodide, more preferably silver iodide or silver iodobromide (iodide content 10 to 40 mole %), and most preferably silver iodide.

It is important that this internal iodide-rich phase be not evenly deposited on the face of a substrate tabular grain but localized. Such localization may occur at any of the major face, the side face, the edge, and the corner of a tabular grain. It is also possible to selectively, epitaxially coordinate the internal iodide-rich phase on these sites. For this purpose, it is preferable to use a so-called conversion method by which an iodide salt is singly added.

The above method makes it possible to prepare tabular grains in which at least 70% of the total projected area are occupied by tabular grains with an aspect ratio of 8 or more, and the variation coefficient of the grain size distribution of these grains which account for 70% or more is 20% or less.

In addition, it is possible to form silver halide photographic grains 50% or more of which are grains in which 10 or more dislocations are present per grain. As for an intergrain iodide distribution, however, it is effective to chose the following conditions in singly adding an iodide salt to form dislocations in order for the silver iodide contents of individual grains to be uniform. That is, the pAg before addition of an iodide salt ranges between preferably 8.5 and 10.5, and more preferably 9.0 and 10.5. The temperature is preferably kept between 50° C. and 30° C. It is also favorable to add an iodide salt in an amount of 1 mol % with respect to the total silver amount under sufficient stirring over 30 seconds to five minutes.

The iodide content of the substrate tabular grain is lower than that of the iodide-rich phase, and is preferably 0 to 12 mol %, and more preferably 0 to 10 mol %.

The silver iodide content of the outer phase which covers the iodide-rich phase is lower than that of the iodide-rich phase, and is preferably 0 to 12 mol %, more preferably 0 to 10 mol %, and most preferably 0 to 3 mol %.

The internal iodide-rich phase is preferably present within a silver amount region of 5 to 80 mol %, more preferably 10 to 70 mol %, and most preferably 20 to 60 mol % of the total silver amount of a tabular grain with respect to the major axis of the grain.

The direction of the major axis of a grain is the direction of the diameter of a tabular grain, and the direction of the minor axis of a grain is the direction of the thickness of a tabular grain.

The iodide content of the internal iodide-rich phase is higher than an average iodide content of silver bromide, silver iodobromide, or silver bromochloroiodide present on the surface of a grain, preferably five times or more, and most preferably 20 times or more the average iodide content.

The silver amount of a silver halide forming the internal iodide-rich phase is preferably 50 mol % or less, more preferably 10 mol % or less, and most preferably 5 mol % or less of the silver amount of the entire grain.

A silver halide solvent is useful for the purpose of promoting ripening, as mentioned before. As an example, it is known to make an excess of halogen ions exist in a reactor vessel in order to promote ripening. It is obvious from this fact that ripening can be encouraged only by introducing a halide salt solution into a reactor vessel. Other ripening agents than halogen ions can also be used. The total amount of these ripening agents can be mixed in a dispersing medium placed in a reactor vessel before addition of silver and a halide salt or can be introduced to the reactor vessel simultaneously with addition of one or more of a halide salt, a silver salt, and a deflocculant. Alternatively, ripening agents can be independently added in the step of adding a halide salt and a silver salt.

Examples of the ripening agent other than halogen ions are ammonia, an amine compound, a thiocyanate, e.g., an alkali metal thiocyanate, particularly sodium thiocyanate and potassium thiocyanate, and ammonium thiocyanate. The use of a thiocyanate ripening agent is disclosed in U.S. Pat. Nos. 2,222,264, 2,448,534, and 3,320,069. It is also possible to use regularly used thioether ripening agents such as described in U.S. Pat. Nos. 3,271,157, 3,574,628, and 3,737,313. Thione compounds disclosed in JP-A-53-82408 and JP-A-53-144319 also are usable.

The properties of silver halide grains can be controlled by making various compounds exist in a silver halide precipitation formation step. Such compounds can be made exist initially in a reactor vessel or added together with one or more salts in accordance with conventional methods. It is possible to control the characteristics of a silver halide by allowing copper, iridium, lead, bismuth, cadmium, zinc, (e.g., chalcogen compounds such as of sulfur, selenium, and tellurium), gold, and compounds of Group VII noble metals to exist in the silver halide precipitation formation step, as described in U.S. Pat. Nos. 2,448,060, 2,628,167, 3,737,313, and 3,772,031, and Research Disclosure Vol. 134, June 1975, 13452. The interiors of grains of a silver halide emulsion can be reduction-sensitized during the precipitation formation step as described in JP-B-5-1410 and Moisar et al., Journal of Photographic Science, Vol. 25, 1977, pages 19 to 27.

The tabular grain used in the present invention can be junctioned with a silver halide with a different composition through epitaxial junction, or junctioned with a compound other than a silver halide, such as silver rhodanate or lead oxide. These emulsion grains are disclosed in U.S. Pat. Nos. 4,094,684, 4,142,900, and 4,459,353, British Patent 2,038,792, U.S. Pat. Nos. 4,349,622, 4,395,478, 4,433,501, 4,463,087, 3,656,962, and 3,852,367, and JP-A-59-162540.

The tabular grains of the present invention are normally, chemically sensitized.

The chemical sensitization can be performed by using an active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. The chemical sensitization is optimally performed in the presence of a gold compound and a thiocyanate compound, or in the presence of a sulfur-containing compound described in U.S. Pat. Nos. 3,857,711, 4,266,018, and 4,054,457 or a sulfur-containing compound such as hypo, a thiourea-based compound, or a rhodanine-based compound. The chemical sensitization can also be performed in the presence of a chemical sensitization aid. Examples of the chemical sensitization aid are azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143. In addition to or in place of the chemical sensitization, reduction sensitization can be performed by using, e.g., hydrogen, as described in U.S. Pat. Nos. 3,891,446 and 3,984,249. It is also possible to perform the reduction sensitization by using stannous chloride, thiourea dioxide, polyamine, and a reducing agent of this sort, as described in U.S. Pat. Nos. 2,518,698, 2,743,182, and 2,743,183, or through a low-pAg (e.g., lower than 5) and/or high-pH (e.g., greater than 8) processing. Color sensitivity also can be improved by chemical sensitization methods described in U.S. Pat. Nos. 3,917,485 and 3,966,476.

It is also possible to apply a sensitizing method using an oxidizer described in JP-A-61-3134 or JP-A-61-3136.

An emulsion composed of the tabular grains of the present invention can be used together with an emulsion consisting of silver halide grains (to be referred to as nontabular grains hereinafter) subjected to normal chemical sensitization in the same silver halide emulsion layer. Especially in the case of a color photographic light-sensitive material, it is possible to use a tabular grain emulsion and a nontabular grain emulsion in different emulsion layers and/or the same emulsion layer. Examples of the nontabular grains are regular grains having regular crystal shapes, such as cubic grains, octahedral grains, and tetradecahedral grains, and grains having irregular crystal shapes, such as potato-like grains. A silver halide of these nontabular grains can be any of silver bromide, silver iodobromide, silver bromochloroiodide, silver chlorobromide, and silver chloride. A silver halide is preferably silver iodobromide or silver bromochloroiodide containing 30 mol % or less of silver iodide, and most preferably silver iodobromide containing 2 to 25 mol % of silver iodide.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, No. 4,705,744, No. 4,707,436, JP-A-62-160448, and JP-A-63-89850.

As described above, various layer configurations and arrangements can be selected in accordance with the application of the light-sensitive material.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions can be prepared by methods described in, for example, U.S. Pat. Nos. 3,574,628 and 3,655,394, and British Patent 1,413,748 are also preferred.

Tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion.

In the present invention, a non-light-sensitive fine-grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The unfogged fine-grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm. The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-l-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401, 752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl) benzimidazole, which are described in JP-A-63-257747, JP-A-62-272248, and JP-A-1-80941.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloid layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness-film thickness)/film thickness.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, and the sulfates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

Processing solutions except for the color developer and processing steps of the color reversal light-sensitive material of the present invention will be described below.

Of the processing steps of the color reversal light-sensitive material of the present invention, those from black-and-white (B/W) development to color development are as follows.

1) B/W development—washing—reversal—color development

2) B/W development—washing—photo-reversal—color development

3) B/W development—washing—color development

The washing in any of the processes 1) to 3) can be replaced with rinsing described in U.S. Pat. No. 4,804,616 in order to simplify the process and reduce the quantity of a waste liquor.

Steps after the color development will be described.

4) Color development—conditioning—bleaching—fixing—washing—stabilization

5) Color development—washing—bleaching—fixing—washing—stabilization

6) Color development—conditioning—bleaching—washing—fixing—washing—stabilization 7) Color development—washing—bleaching—washing—fixing—washing—stabilization 8) Color development—bleaching—fixing—washing—stabilization 9) Color development—bleaching—bleach-fixing—washing—stabilization 10) Color development—bleaching—bleach-fixing—fixing—washing—stabilization 11) Color development—bleaching—washing—fixing—washing—stabilization 12) Color development—conditioning—bleach-fixing—washing—stabilization 13) Color development—washing—bleach-fixing—washing—stabilization 14) Color development—bleach-fixing—washing—stabilization 15) Color development—fixing—bleach-fixing—washing—stabilization In the processes 4) to 15), the washing immediately before the stabilization can be omitted, and the last stabilization step need not be performed. One of the processes 1) tttto 3) and one of the processes 4) to 15) combine together to form a color reversal process.

Processing solutions used in the color reversal process of the present invention will be described below.

As a B/W developing solution for use in the present invention, it is possible to use developing agents known to those skilled in the art. Examples of the developing agent are dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and a heterocyclic compound described in U.S. Pat. No. 4,067,872, in which a 1,2,3,4-tetrahydroquinoline ring and an indolene ring are condensed. These developing agents can be used singly or in a combination of two or more types of them.

The B/W developing solution for use in the present invention can contain, if necessary, a preservative (e.g., a sulfite or a bisulfite), a buffering agent (e.g., a carbonate, boric acid, a borate salt, or an alkanolamine), an alkaline agent (e.g., a hydroxide or a carbonate salt), a solubilizing aid (e.g., polyethyleneglycols or their esters), a pH control agent (e.g., an organic acid such as acetic acid), a sensitizer (e.g., a quaternary ammonium salt), a development accelerator, a surfactant, an anti-foaming agent, a film hardener, and a viscosity-imparting agent.

It is necessary to add a compound acting as a silver halide solvent to the B/W developing solution used in the present invention. In general, however, a sulfite salt to be added as the preservative described above plays this role as a solvent. Examples of a sulfite and other usable silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

Although the pH of a developing solution thus prepared is so selected as to yield desired density and contrast, it falls within the range of about 8.5 to about 11.5.

To perform sensitization using such a B/W developing solution, a processing time is prolonged a maximum of about three times that of standard processing. In this case, raising the processing temperature can shorten the time prolonged for sensitization.

The pH of the color and black-and-white developers is generally 9 to 12. Although the quantity of a replenisher of these developers depends on a color photographic light-sensitive material to be processed, it is generally 3 liters or less per $m^2$ of the light-sensitive material. The quantity of a replenisher can be decreased to be 500 ml or less by decreasing a bromide ion concentration in the replenisher. When the quantity of a replenisher is to be decreased, a contact area of a processing tank with air is preferably decreased to prevent evaporation and oxidation of the replenisher.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing accumulation of bromide ions in the developing solution.

The present invention will be described in more detail below by way of its examples, but the present invention is not limited to these examples.

EXAMPLE 1

(Preparation of emulsions)

While one liter of water containing 0.41 g of gelatin oxide, 4.2 ml of 4N nitric acid, 0.73 g of KBr, and 0.181 g of PLURONIC TM-31R1 manufactured by BASF Co., indicated below was stirred at 45° C. in a reactor vessel, 2.75 ml of an aqueous solution containing 0.37 g of $AgNO_3$ and 2.83 ml of an aqueous solution containing 0.27 g of KBr were added to the reactor vessel over one minute by a double jet method while the temperature was kept at 45° C. When one minute elapsed, 19.2 ml of an aqueous solution containing 2.29 g of KBr were added to the resultant solution, and the temperature was raised to 60° C. over nine minutes. Subsequently, an aqueous ammonia solution containing 3.37 g of $(NH_4)_2SO_4$ and 26.7 ml of a 2.5N NaOH solution was added, and the resultant solution was stirred for nine minutes. 94.2 ml of an aqueous solution containing 16.7 g of oxidized alkali-processed gelatin and 10.8 ml of 4N nitric acid was then added to the solution over two minutes. Thereafter, 7.5 ml of an aqueous solution containing 1.02 g of $AgNO_3$, and 8.3 ml of an aqueous solution containing 0.79 g of KBr were added to the resultant solution over five minutes at constant addition rates. 474.7 ml of an aqueous solution containing 129 g of $AgNO_3$ and 474.7 ml of an aqueous solution containing 95 g of KBr were then simultaneously added over 64 minutes while flow rates were accelerated constantly from initial flow rates of 1.5 ml/min and 1.62 ml/min, respectively.

Subsequently, 290 ml of an aqueous solution containing 2.9 g of KI were singly added to the resultant solution over two minutes. When two minutes elapsed, 253.3 ml of an aqueous solution containing 68.8 g of $AgNO_3$, and 252 ml of an aqueous solution containing 50.3 g of KBr were simultaneously added at constant flow rates over 19 minutes.

Thereafter, desalting was performed by a regular flocculation method, and the pH and the pAg were adjusted to 6.5 and 8.5, respectively, at 40° C. Chemical sensitization was then optimally performed at 65° C. in the presence of sensitizing dyes (S-6 and S-7 to be described later) by using sodium thiosulfate, chloroauric acid, and potassium thiocyanate, thereby obtaining a tabular AgBrI emulsion 1 (AgI content=1.5 mol %). The resultant grains were found to have a mean projected area diameter of 2.0 μm and a mean grain thickness of 0.133 μm. The ratio of a projected area accounted for by tabular grains was 99%. The mean aspect ratio was 15.0, the average tabularity of the grains was 113, and the variation coefficient of the grain diameter was 5.0%.

PLURONIC used:

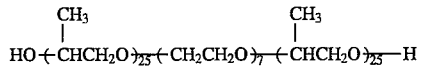

Emulsions 2 to 5 were prepared following the same procedures as for the emulsion 1 except that the amount of KBr contained in the reactor vessel before addition of silver nitrate was changed to s grams, the amount of KBr added one minute after the addition of the first silver nitrate was changed to t grams, the amount of 2.5N NaOH added after the temperature was raised was changed to u ml, and s, t, and u were controlled as shown in Table 3 below.

Note that the amount of nitric acid added during the preparation was controlled such that the pH was the same as that of the emulsion 1. Note also that in the emulsion 5, the amount of gelatin contained in the reactor vessel before addition of silver nitrate was 0.82 g.

TABLE 3

| Emulsion No. | s | t | u |
|---|---|---|---|
| 1 | 0.73 | 2.29 | 26.7 |
| 2 | 3.0 | 1.0 | 15.0 |
| 3 | 5.0 | — | 26.7 |
| 4 | 5.0 | — | 53.4 |
| 5 | 0.73 | 2.29 | — |

Observation of grain sectional photographs was then performed in accordance with the following method. That is, a coated sample in which tabular grains were arranged parallel was cut into a sample piece with a thickness of about 0.1 μm by using a diamond knife. Twin planes of twinned grains could be found by observing this sample piece by using a transmission electron microscope.

This electron micrograph was taken, and a spacing a of twin planes and a grain thickness b were measured on the micrograph, thereby calculating b/a. In a b/a distribution obtained for the emulsion 1, the ratio of $1 \leqq b/a < 1.5$ was 1%, the ratio of $1.5 \leqq b/a < 2.5$ was 70%, and the ratio of $2.5 \leqq b/a < 5$ was 4%.

Data concerning the grains of the emulsions 1 to 5 prepared as described above are summarized in Table 4 below.

TABLE 4

| Emulsion No. | | Average projected area equivalent-circle diameter (mm) | Average grain thickness b (mm) | Ratio (%) of projected area occupied by tabular grains | Average aspect ratio | Variation coefficient (%) of grain diameter |
|---|---|---|---|---|---|---|
| 1 | Present invention | 2.00 | 0.133 | 99 | 15.0 | 5.0 |
| 2 | Present invention | 2.00 | 0.135 | 100 | 14.8 | 5.1 |
| 3 | Comparative example | 2.03 | 0.140 | 100 | 14.5 | 5.0 |
| 4 | Comparative example | 2.12 | 0.150 | 99 | 14.1 | 5.0 |
| 5 | Comparative example | 2.20 | 0.110 | 97 | 20.0 | 9.0 |

| Emulsion | Distribution of b/a (%) | | | | |
|---|---|---|---|---|---|
| No. | 1 < b/a < 1.5 | 1.5 < b/a < 2.5 | 2.5 < b/a < 5 | 5 < b/a < 8 | 8 < b/a |
| 1 | 1 | 70 | 25 | 4 | 0 |
| 2 | 0 | 15 | 65 | 18 | 2 |
| 3 | 0 | 2 | 22 | 61 | 15 |
| 4 | 0 | 0 | 5 | 30 | 65 |
| 5 | 51 | 43 | 4 | 2 | 0 |

(Making of Coated Samples)

The individual emulsions prepared as described above were added with dodecylbenzenesulfonate as a coating aid, p-vinylbenzenesulfonate as a thickening agent, a vinylsulfone-based compound as a hardener, and a polyethylene oxide-based compound as a photographic characteristics-improving agent, thereby forming emulsion coating solutions. These coating solutions were independently coated evenly on an undercoated polyester base, and a surface protective layer consisting primarily of an aqueous gelatin solution was coated on each resultant structure, making coated samples 101 to 105 having the emulsions 1 to 5, respectively. In these samples 101 to 105, the coating silver amount was 4.0 g/m$^2$, the coating gelatin amount in the protective layer was 1.3 g/m$^2$, the coating gelatin amount in the emulsion layer was 2.7 g/m$^2$.

The following experiments were conducted in order to evaluate these coated samples.

First, sample pieces of the coated samples 101 to 105 were wedge-exposed with an exposure amount of 10 CMS for an exposure time of 1/100 sec and developed at 20° C. for four minutes by using a processing solution with a composition described below. Subsequently, after fixing, washing, and drying were performed, sensitometry was performed to obtain sensitivity from the reciprocal of an exposure amount by which a density of fog+0.1 was given.

In addition, two sets of sample pieces of the coated samples 101 to 105 were prepared. One set was stored in an atmosphere at a temperature of 55° C. and a relative humidity (RH) of 55% for three days, and the other set was stored at room temperature as a control. These two sets were then developed following the same procedures as described above, evaluating the incubation resistance.

Furthermore, additional two sets of sample pieces of the coated samples 101 to 105 were prepared and wedge-exposed for 1/100". One set was stored in an atmosphere at 50° C. and 55% RH, and the other set was stored in a freezer as a control. These two sets were then developed following the same procedures as described above, evaluating the latent image stability.

The results are summarized in Table 5 below.

TABLE 5

| Coated sample No. | Emulsion No. | Incubation resistance+) (%) | Later image stability+) (%) | |
|---|---|---|---|---|
| 101 | 1 | 96 | 93 | Present invention |
| 102 | 2 | 96 | 97 | Present invention |
| 103 | 3 | 85 | 97 | Comparative example |
| 104 | 4 | 70 | 98 | Comparative example |
| 105 | 5 | 97 | 70 | Comparative example |

+)Each of the incubation resistance and the latent image stability is represented by a relative value of the sensitivity assuming that the sensitivity of a control of each sample is 100.

Processing solution

| | |
|---|---|
| 1-phenyl-3-pyrazolidone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethyleneglycol | 20 g |
| pH was adjusted to 10.0 by using sodium hydroxide | |
| Water to make | 1 liter |

As is apparent from Table 5, the samples 101 and 102 of the present invention which had monodisperse tabular grains with an aspect ratio of 8 or more, and in which 50% (number) or more of all tabular grains were distributed within the range of a b/a value of 1.5 to less than 5 (see Table 4), had a high incubation resistance and a high latent image stability, indicating the significant advantage of the present invention.

EXAMPLE 2

(Making of Sample 201)

A multilayered color light-sensitive material was prepared by forming layers having the following compositions on an undercoated 127-μm thick cellulose triacetate film support, thereby making a sample 201. The numbers indicated below represent addition amounts per $m^2$. The effect of each compound added is not limited to the one described.

| | | |
|---|---|---|
| **1st layer: Antihalation layer** | | |
| Black colloidal silver | silver | 0.20 g |
| Gelatin | | 1.9 g |
| Ultraviolet absorbent U-1 | | 0.1 g |
| Ultraviolet absorbent U-3 | | 0.04 g |
| Ultraviolet absorbent U-4 | | 0.1 g |
| High-boiling organic solvent Oil-1 | | 0.1 g |
| Microcystalline solid dispersion of Dye E-1 | | 0.1 g |
| **2nd layer: Interlayer** | | |
| Gelatin | | 0.40 g |
| Compound Cpd-C | | 5 mg |
| Compound Cpd-J | | 5 mg |
| Compound Cpd-K | | 3 mg |
| High-boiling organic solvent Oil-3 | | 0.1 g |
| Dye D-4 | | 0.8 mg |
| **3rd layer: Interlayer** | | |
| Silver iodobromide emulsion consisting of fine grains with fogged surfaces and interiors (average grain size 0.06 μm, variation coefficient 18%, AgI content 1 mol %) | silver | 0.05 g |
| Yellow colloidal silver | silver | 0.05 g |
| Gelatin | | 0.4 g |
| **4th layer: Low-speed red-sensitive emulsion layer** | | |
| Emulsion A | silver | 0.1 g |
| Emulsion B | silver | 0.4 g |
| Silver iodobromide emulsion consisting of fine grains with fogged interiors (average grain size 0.06 μm, variation coefficient 18%, AgI content 1 mol %) | silver | 0.05 g |
| Gelatin | | 0.8 g |
| Coupler C-1 | | 0.15 g |
| Coupler C-2 | | 0.05 g |
| Coupler C-3 | | 0.05 g |
| Coupler C-9 | | 0.05 g |
| Compound Cpd-C | | 5 mg |
| Compound Cpd-J | | 5 mg |
| High-boiling organic solvent Oil-2 | | 0.1 g |
| Additive PL-1 | | 0.1 g |
| **5th layer: Medium-speed red-sensitive emulsion layer** | | |
| Emulsion C | silver | 0.5 g |
| Silver iodobromide emulsion consisting of fine grains with fogged interiors (average grain size 0.06 μm, variation coefficient 18%, AgI content 1 mol %) | silver | 0.05 g |
| Gelatin | | 0.8 g |
| Coupler C-1 | | 0.2 g |
| Coupler C-2 | | 0.05 g |
| Coupler C-3 | | 0.2 g |
| High-boiling organic solvent Oil-2 | | 0.1 g |
| Additive PL-1 | | 0.1 g |
| **6th layer: High-speed red-sensitive emulsion layer** | | |
| Emulsion D | silver | 0.4 g |
| Gelatin | | 1.1 g |
| Coupler C-1 | | 0.3 g |
| Coupler C-2 | | 0.1 g |
| Coupler C-3 | | 0.7 g |
| Additive PL-1 | | 0.1 g |
| **7th layer: Interlayer** | | |
| Gelatin | | 0.6 g |
| Additive M-1 | | 0.3 g |
| Color mixing inhibitor Cpd-1 | | 2.6 mg |
| Dye D-5 | | 0.02 g |
| Compound Cpd-J | | 5 mg |
| High-boiling organic solvent Oil-1 | | 0.02 g |
| **8th layer: Interlayer** | | |
| Silver iodobromide emulsion consisting of grains with fogged surfaces and interiors (average grain size 0.06 μm, variation coefficient 16%, AgI content 0.3 mol %) | silver | 0.02 g |
| Yellow colloidal silver | silver | 0.02 g |
| Gelatin | | 1.0 g |
| Additive PL-1 | | 0.2 g |
| Color mixing inhibitor Cpd-A | | 0.1 g |
| Compound Cpd-C | | 0.1 g |
| **9th layer: Low-speed green-sensitive emulsion layer** | | |
| Emulsion E | silver | 0.3 g |
| Emulsion F | silver | 0.2 g |
| Silver iodobromide emulsion consisting of fine grains with fogged interiors (average grain size 0.06 μm, variation coefficient 18%, AgI content 1 mol %) | silver | 0.04 g |
| Gelatin | | 0.5 g |
| Coupler C-4 | | 0.1 g |
| Coupler C-7 | | 0.05 g |
| Coupler C-8 | | 0.20 g |
| Compound Cpd-B | | 0.03 g |
| Compound Cpd-D | | 0.02 g |
| Compound Cpd-E | | 0.02 g |
| Compound Cpd-F | | 0.04 g |
| Compound Cpd-J | | 10 mg |
| Compound Cpd-L | | 0.02 g |
| High-boiling organic solvent Oil-1 | | 0.1 g |
| High-boiling organic solvent Oil-2 | | 0.1 g |
| **10th layer: Medium-speed green-sensitive emulsion layer** | | |
| Emulsion F | silver | 0.3 g |
| Emulsion G | silver | 0.1 g |
| Silver iodobromide emulsion consisting of fine grains with fogged interiors (average grain size 0.06 μm, variation coefficient 18%, AgI content 1 mol %) | silver | 0.04 g |
| Gelatin | | 0.6 g |
| Coupler C-4 | | 0.1 g |
| Coupler C-7 | | 0.2 g |
| Coupler C-8 | | 0.1 g |
| Compound Cpd-B | | 0.03 g |
| Compound Cpd-D | | 0.02 g |
| Compound Cpd-E | | 0.02 g |
| Compound Cpd-F | | 0.05 g |
| Compound Cpd-L | | 0.05 g |
| High-boiling organic solvent Oil-2 | | 0.01 g |
| **11th layer: High-speed green-sensitive emulsion layer** | | |
| Emulsion H | silver | 0.5 g |
| Gelatin | | 1.0 g |
| Coupler C-4 | | 0.3 g |
| Coupler C-7 | | 0.1 g |
| Coupler C-8 | | 0.1 g |
| Compound Cpd-B | | 0.08 g |
| Compound Cpd-E | | 0.02 g |
| Compound Cpd-F | | 0.04 g |

-continued

| | | |
|---|---|---|
| Compound Cpd-K | | 5 mg |
| Compound Cpd-L | | 0.02 g |
| High-boiling organic solvent Oil-1 | | 0.02 g |
| High-boiling organic solvent Oil-2 | | 0.02 g |
| 12th layer: Interlayer | | |
| Gelatin | | 0.6 g |
| Compound Cpd-L | | 0.05 g |
| High-boiling organic solvent Oil-1 | | 0.05 g |
| 13th layer: Yellow filter layer | | |
| Yellow colloidal silver | silver | 0.07 g |
| Gelatin | | 1.1 g |
| Color mixing inhibitor Cpd-A | | 0.01 g |
| Compound Cpd-L | | 0.01 g |
| High-boiling organic solvent Oil-1 | | 0.01 g |
| Microcrystalline solid dispersion of Dye E-2 | | 0.05 g |
| 14th layer: Interlayer | | |
| Gelatin | | 0.6 g |
| 15th layer: Low-speed blue-sensitive emulsion layer | | |
| Emulsion I | silver | 0.4 g |
| Emulsion J | silver | 0.2 g |
| Gelatin | | 0.8 g |
| Coupler C-5 | | 0.2 g |
| Coupler C-6 | | 0.1 g |
| Coupler C-10 | | 0.4 g |
| 16th layer: Medium-speed blue-sensitive emulsion layer | | |
| Emulsion K | silver | 0.4 g |
| Gelatin | | 0.9 g |
| Coupler C-5 | | 0.1 g |
| Coupler C-6 | | 0.1 g |
| Coupler C-10 | | 0.6 g |
| 17th layer: High-speed blue-sensitive emulsion layer | | |
| Emulsion 1 described in Example 1 | silver | 0.4 g |
| Gelatin | | 1.2 g |
| Coupler C-5 | | 0.1 g |
| Coupler C-6 | | 0.1 g |
| Coupler C-10 | | 0.6 g |

-continued

| | | |
|---|---|---|
| High-boiling organic solvent Oil-2 | | 0.1 g |
| 18th layer: 1st protective layer | | |
| Gelatin | | 0.7 g |
| Ultraviolet absorbent U-1 | | 0.2 g |
| Ultraviolet absorbent U-2 | | 0.05 g |
| Ultraviolet absorbent U-5 | | 0.3 g |
| Formalin scavenger Cpd-H | | 0.4 g |
| Dye D-1 | | 0.15 g |
| Dye D-2 | | 0.05 g |
| Dye D-3 | | 0.1 g |
| 19th layer: 2nd protective layer | | |
| Colloidal silver | silver | 0.1 mg |
| Fine grain silver iodobromide emulsion (average grain size 0.06 μm, AgI content 1 mol %) | silver | 0.1 mg |
| Gelatin | | 0.4 g |
| 20th layer: 3rd protective layer | | |
| Gelatin | | 0.4 g |
| Polymethylmethacrylate (average grain size 1.5 μm) | | 0.1 g |
| Copolymer of methylmethacrylate and acrylic acid (4:6) (average grain size 1.5 μm) | | 0.1 g |
| Silicone oil | | 0.03 g |
| Surfactant W-1 | | 3.0 mg |
| Surfactant W-2 | | 0.03 g |

In addition to the above compositions, all of the emulsion layers were added with additives F-1 to F-8. In addition, the individual layers were added with a gelatin hardener H-1 and surfactants W-3, W-4, W-5, and W-6 for coating and emulsification in addition to the above compositions.

Furthermore, the sample was also added with phenol, 1,2-benzisothiazolin-3-one, 2-phenoxyethanol, phenethyl alcohol, and butyl p-benzoate as antiseptic and mildew-proofing agents.

The silver iodobromide emulsions used in the sample 201 are listed in Table 6 below.

TABLE 6

| Emulsion name | Grain shape | | Average grain size (μm) | Variation coefficient (%) | AgI content (%) |
|---|---|---|---|---|---|
| A | Monodisperse tetradecahedral grain | | 0.25 | 16 | 3.7 |
| B | Monodisperse cubic grain | | 0.35 | 10 | 3.3 |
| C | Monodisperse tabular grain | Average aspect ratio 4.0 | 0.47 | 18 | 5.0 |
| D | Monodisperse tabular grain | Average aspect ratio 7.0 | 0.68 | 16 | 2.0 |
| E | Monodisperse cubic grain | | 0.20 | 16 | 4.0 |
| F | Monodisperse cubic grain | | 0.35 | 11 | 3.5 |
| G | Monodisperse cubic grain | | 0.45 | 9 | 3.5 |
| H | Monodisperse tabular grain | Average aspect ratio 7.0 | 0.80 | 13 | 1.5 |
| I | Monodisperse tetradecahedral grain | | 0.30 | 18 | 4.0 |
| J | Monodisperse cubic grain | | 0.40 | 14 | 3.5 |
| K | Monodisperse tabular grain | Average aspect ratio 7.0 | 0.55 | 13 | 3.5 |
| l | Monodisperse tabular grain | Average aspect ratio 15.0 | 0.93 | 5 | 1.5 |

Note: The aspect ratio can be calculated by averaging the grain diameter/grain thickness ratios of all tabular grains. The aspect ratio is obtained more easily as a ratio of the average grain diameter of all tabular grains to the average thickness of all tabular grains.

The sensitizing dyes were added as described in Table 7 below immediately before chemical sensitization of the emulsions A to K and 1.

TABLE 7

| Emulsion name | Sensitizing dyes added | Addition amount (m · mol) per mol of silver halide |
|---|---|---|
| A | S-1 | 0.44 |
| | S-3 | 0.04 |
| B | S-2 | 0.44 |
| | S-3 | 0.01 |
| C | S-1 | 0.26 |
| | S-3 | 0.02 |
| D | S-1 | 0.18 |
| | S-8 | 0.01 |
| | S-3 | 0.01 |
| E | S-4 | 0.47 |
| | S-5 | 0.15 |
| F | S-4 | 0.31 |
| | S-5 | 0.09 |

TABLE 7-continued

| Emulsion name | Sensitizing dyes added | Addition amount (m · mol) per mol of silver halide |
|---|---|---|
| G | S-4 | 0.30 |
| | S-5 | 0.09 |
| H | S-10 | 0.47 |
| | S-5 | 0.06 |
| | S-9 | 0.13 |
| I | S-7 | 0.27 |
| | S-6 | 0.07 |
| J | S-7 | 0.29 |
| | S-6 | 0.09 |
| K | S-7 | 0.50 |
| | S-6 | 0.15 |
| 1 | S-7 | 0.30 |
| | S-6 | 0.10 |

The compounds added in the manufacture of the sample 201 were as follows,

C-1

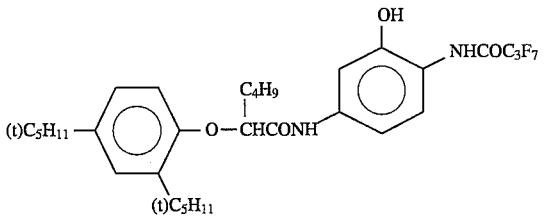

C-2

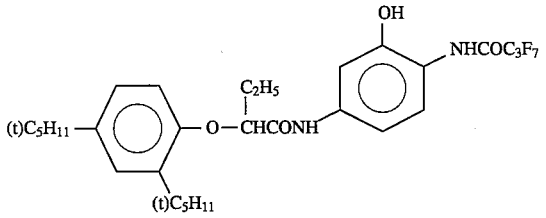

C-3

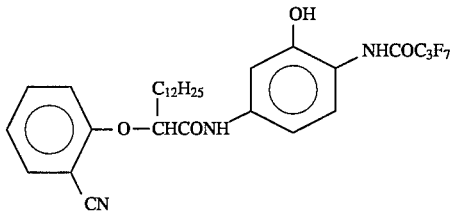

C-4

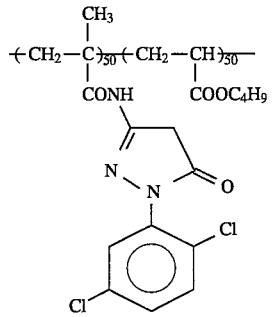

Numbers represent wt %
Average molecular weight about 25,000

-continued
C-5
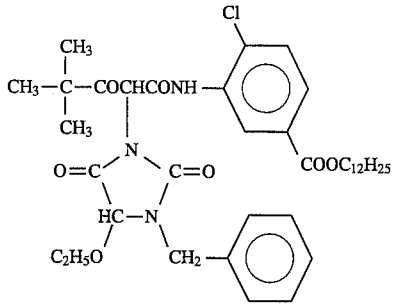
C-6
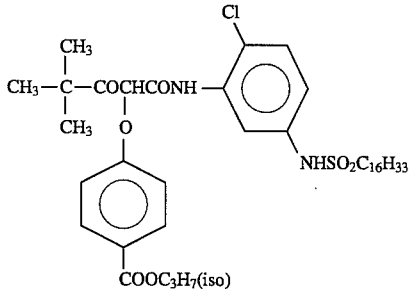
C-7
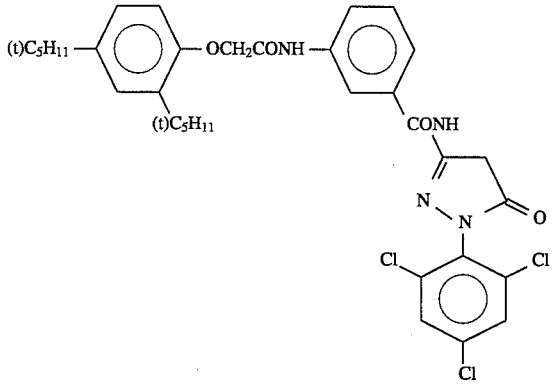
C-11
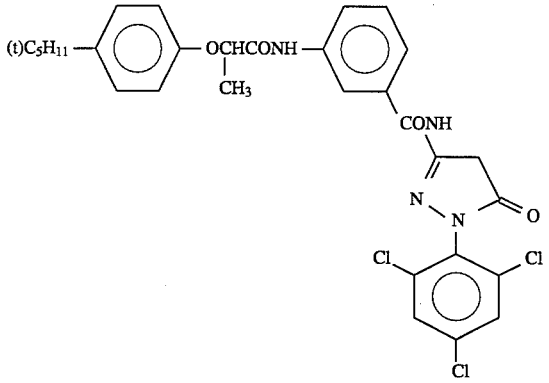
C-8
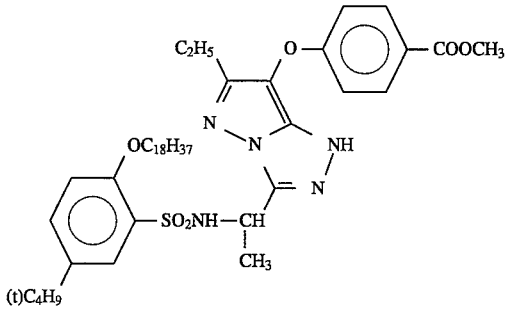

-continued
C-9
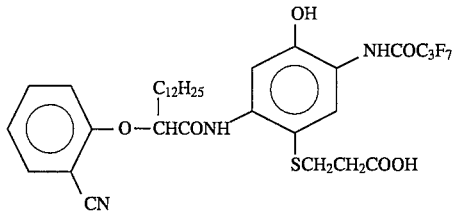
C-10
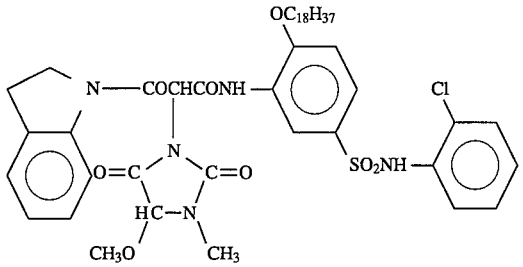
Dibutyl phthalate — Oil-1
Tricresyl phosphate — Oil-2
Oil-3
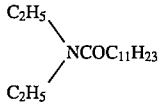
Cpd-A
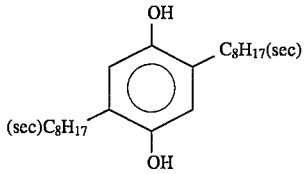
Cpd-B
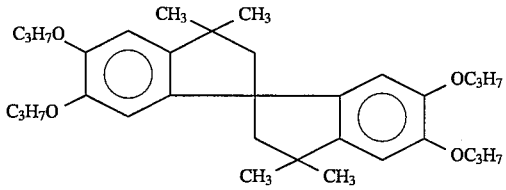
Cpd-C
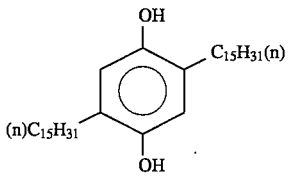
Cpd-D
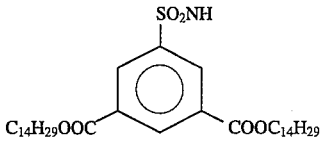
Cpd-E
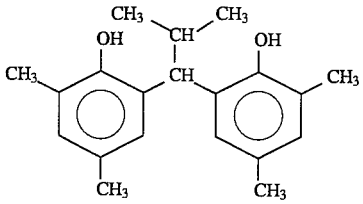

-continued
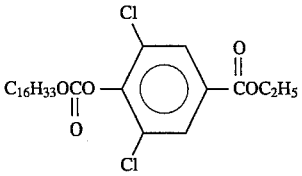
Cpd-F
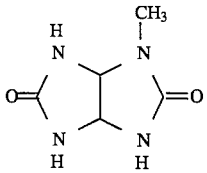
Cpd-H
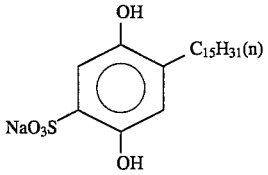
Cpd-I
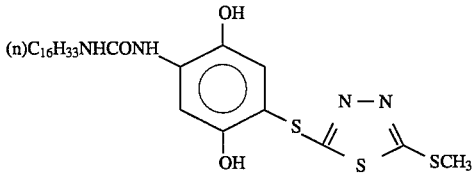
Cpd-J
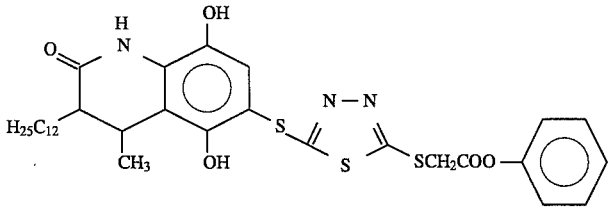
Cpd-K
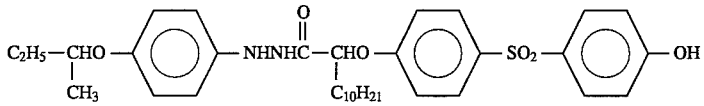
Cpd-L
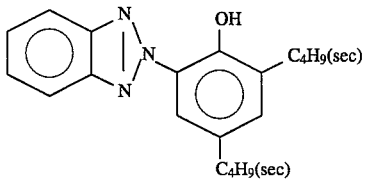
U-1
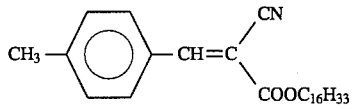
U-2
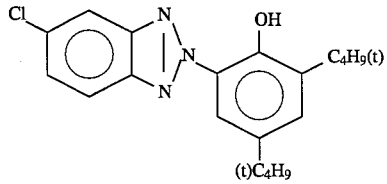
U-3

-continued
U-4
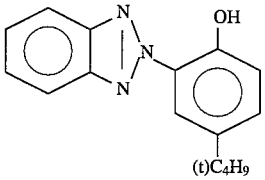
U-5
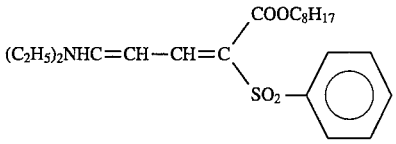
S-1
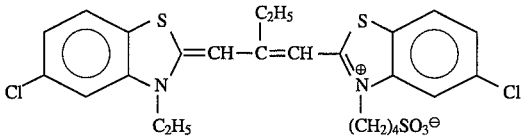
S-2
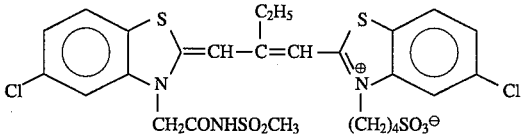
S-3
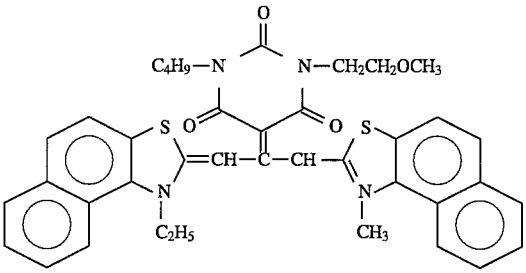
S-4
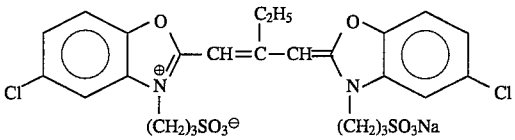
S-8
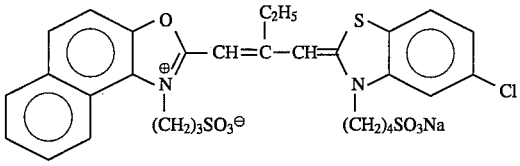
S-5
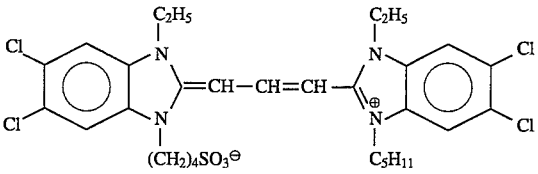
S-6
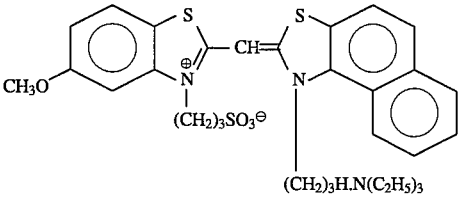

-continued
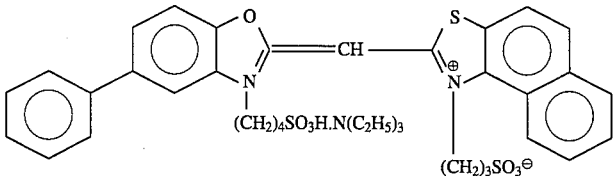
S-7
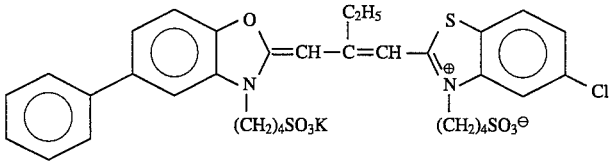
S-9
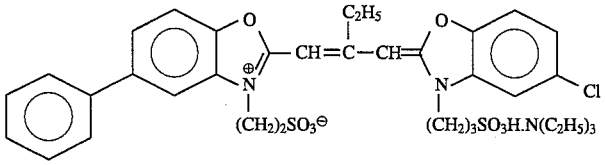
S-10
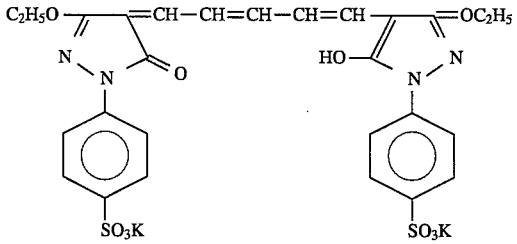
D-1
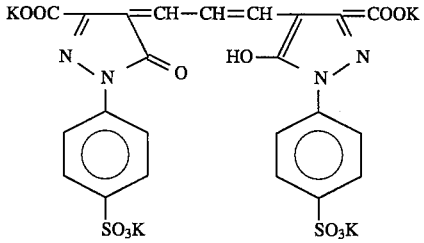
D-2
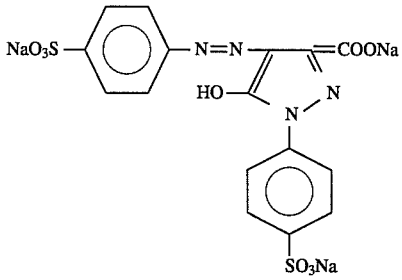
D-3
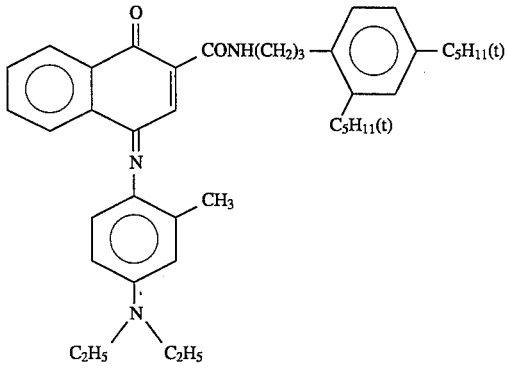
D-4

-continued
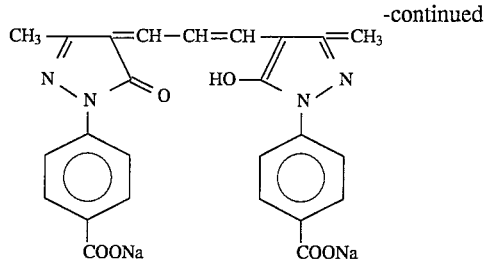
D-5
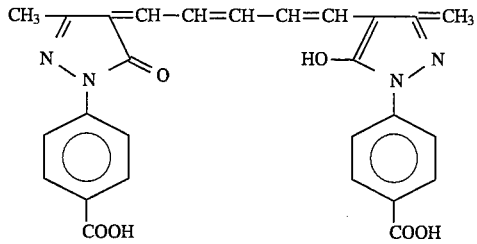
E-1
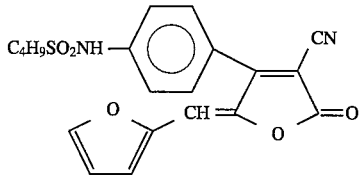
E-2
$CH_2{=}CH{-}SO_2{-}CH_2{-}CONH{-}CH_2$
$CH_2{=}CH{-}SO_2{-}CH_2{-}CONH{-}CH_2$
H-1
$C_8F_17SO_2NHCH_2CH_2CH_2OCH_2CH_2\overset{\oplus}{N}(CH_3)_3$
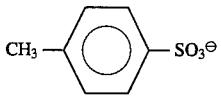
W-1
$C_8F_{17}SO_2N(C_3H_7)CH_2COOk$
W-2
$NaO_3S{-}CH(CH_2COOCH_2CH(C_2H_5)C_4H_9){-}COOCH_2CH(C_2H_5)C_4H_9$
W-3
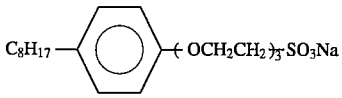
W-4
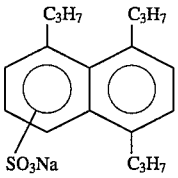
W-5
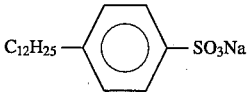
W-6
$\left(CH_2{-}CH(CONHC_4H_9(t))\right)_n$
PL-1
$\left(CH_2{-}CH(COOC_4H_9)\right)_n$
M-1

-continued

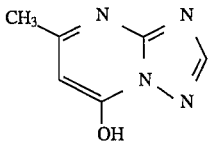

F-1

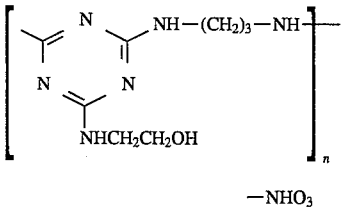

F-2

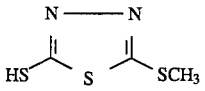

F-3

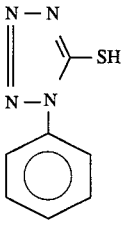

F-4

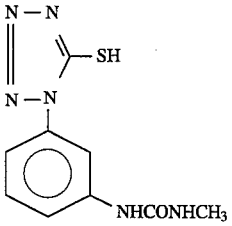

F-5

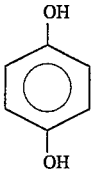

F-6

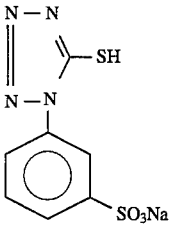

F-7

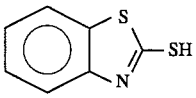

F-8

(Making of Samples 202 to 205)

Samples 202 to 205 were made following the same procedures as for the sample 201 except that the emulsions 2 to 5 were used in place of the emulsion 1 used in the 17th high-speed blue-sensitive emulsion layer in the manufacture of the sample 201.

(Evaluation of Coated Samples)

Sample pieces of the coated samples 201 to 205 obtained as described above were subjected to white wedge exposure with an exposure amount of 20 CMS for an exposure time of 1/100 sec and to the following development, and sensitometry was performed.

In addition, incubation was performed before and after exposure in accordance with the method described in Example 1, testing the incubation resistance and the latent image stability.

| Processing Step | Time | Temperature |
|---|---|---|
| 1st development | 6 min. | 38° C. |
| Washing | 2 min. | 38° C. |
| Reversal | 2 min. | 38° C. |
| Color development | 6 min. | 38° C. |
| Pre-bleaching | 2 min. | 38° C. |
| Bleaching | 6 min. | 38° C. |
| Fixing | 4 min. | 38° C. |
| Washing | 4 min. | 38° C. |
| Final rinsing | 1 min. | 25° C. |

The compositions of the individual processing solutions were as follows.

| (1st developing solution) | |
|---|---|
| Nitrilo-N,N,N-trimethylene-phosphonic acid pentasodium salt | 1.5 g |
| Diethylenetriaminepentaacetic acid pentasodium salt | 2.0 g |
| Sodium sulfite | 30 g |
| Hydroquinone.potassium monosulfonate | 20 g |
| Potassium carbonate | 15 g |
| Sodium bicarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethyleneglycol | 13 g |
| Water to make | 1,000 ml |
| pH | 9.60 |

The pH was adjusted by using sulfuric acid or potassium hydroxide.

| (Reversal solution) | |
|---|---|
| Nitrilo-N,N,N-trimethylene phosphonic acid pentasodium salt | 3.0 g |
| Stannous chloride dihydrate | 1.0 g |
| P-aminophenol | 0.1 g |
| Sodium hydroxide | 8 g |
| Glacial acetic acid | 15 ml |
| Water to make | 1,000 ml |
| pH | 6.00 |

The pH was adjusted by using acetic acid or sodium hydroxide.

| (Color developing solution) | |
|---|---|
| Nitrilo-N,N,N-trimethylene phosphonic acid pentasodium salt | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-(β-methanesulfonamido-ethyl)-3-methyl-4-aminoaniline 3/2 sulfate monohydrate | 11 g |
| 3,6-dithiaoctane-1,8-diol | 1.0 g |

-continued

| (Color developing solution) | |
|---|---|
| Water to make | 1,000 ml |
| pH | 11.80 |

The pH was adjusted using acetic acid or potassium hydroxide.

| (Pre-bleaching solution) | |
|---|---|
| Ethylenediaminetetraacetic acid disodium salt dihydrate | 8.0 g |
| Sodium sulfite | 6.0 g |
| 1-thioglycerol | 0.4 g |
| Adduct of formaldehyde with sodium bisulfite | 30 g |
| Water to make | 1,000 ml |
| pH | 6.20 |

The pH was adjusted by using acetic acid or sodium hydroxide.

| (Bleaching solution) | |
|---|---|
| Ethylenediaminetetraacetic acid disodium salt dihydrate | 2.0 g |
| Ammonium ferric ethylenediaminetetraacetate dihydrate | 120 g |
| Potassium bromide | 100 g |
| Ammonium nitrate | 10 g |
| Water to make | 1,000 ml |
| pH | 5.70 |

The pH was adjusted by using nitric acid or sodium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was adjusted by using acetic acid or ammonia water.

| (Final rinsing solution) | |
|---|---|
| 1,2-benzoisothiazolin-3-one | 0.02 g |
| Polyoxyethylene-p-monononyl-phenylether (average polymerization degree 10) | 0.3 g |
| Polymaleic acid (average molecular weight 2,000) | 0.1 g |
| Water to make | 1,000 ml |
| pH | 7.0 |

The color reversal sensitivity of the 17th high-speed blue-sensitive emulsion layer was estimated on the basis of a relative exposure amount by which a density greater by 2.5 than the minimum yellow density was given, thereby evaluating the incubation resistance and the latent image stability. Consequently, only the samples 201 and 202 were excellent in both the incubation resistance and the latent image stability, indicating the advantage of the present invention.

EXAMPLE 3

A multilayered color light-sensitive material was prepared by forming layers having the following compositions on an undercoated 127 μm thick cellulose triacetate film support, thereby making a sample 301. The numbers indicated below represent addition amounts per $m^2$.

| | |
|---|---|
| 1st layer: Antihalation layer | |
| Gray colloidal silver | 0.34 |
| Gelatin | 2.40 |
| 2nd layer: Interlayer | |
| Gelatin | 1.20 |
| 3rd layer: Low-speed red-sensitive emulsion layer | |
| Emulsion a | silver 0.60 |
| Silver bromide Lippman emulsion | silver 0.06 |
| Gelatin | 0.90 |
| Coupler C-1 | 0.20 |
| High-boiling organic solvent Oil-1 | 0.10 |
| Compound Cpd-M | 0.05 |
| 4th layer: High-speed red-sensitive emulsion layer | |
| Emulsion b | silver 0.50 |
| Fine grain silver iodobromide emulsion (AgI 4.8%) | silver 0.05 |
| Gelatin | 1.50 |
| Coupler C-1 | 0.90 |
| High-boiling organic solvent Oil-1 | 0.40 |
| 5th layer: Interlayer | |
| Gelatin | 0.60 |
| Compound Cpd-M | 0.16 |
| D-6 | 0.65 |
| 6th layer: Interlayer | |
| Gelatin | 0.60 |
| 7th layer: Low-speed green-sensitive emulsion layer | |
| Emulsion c | silver 0.45 |
| Gelatin | 0.90 |
| Coupler C-11 | 0.20 |
| Coupler C-7 | 0.07 |
| High-boiling organic solvent Oil-2 | 0.11 |
| 8th layer: High-speed green-sensitive emulsion layer | |
| Emulsion 1 of Example 1 | silver 0.45 |
| Silver bromide Lippman emulsion | silver 0.07 |
| Fine grain silver iodobromide emulsion (AgI 4.8%) | silver 0.05 |
| Gelatin | 1.50 |
| Coupler C-11 | 0.60 |
| Coupler C-7 | 0.25 |
| High-boiling organic solvent Oil-2 | 0.40 |

-continued

| | |
|---|---|
| 9th layer: Interlayer | |
| Gelatin | 0.60 |
| 10th layer: Interlayer | |
| Gelatin | 0.60 |
| Compound Cpd-M | 0.11 |
| Dye D-7 | 0.27 |
| 11th layer: Low-speed blue-sensitive emulsion layer | |
| Emulsion e | silver 0.45 |
| Gelatin | 0.90 |
| Coupler C-5 | 0.18 |
| High-boiling organic solvent Oil-1 | 0.06 |
| Compound Cpd-M | 0.05 |
| 12th layer: High-speed blue-sensitive emulsion layer | |
| Emulsion f | silver 0.55 |
| Silver bromide Lippman emulsion | silver 0.07 |
| Fine grain silver iodobromide emulsion (AgI 4.8%) | silver 0.05 |
| Gelatin | 2.40 |
| Coupler C-5 | 1.55 |
| High-boiling organic solvent Oil-1 | 0.50 |
| 13th layer: 1st protective layer | |
| Ultraviolet absorbent U-6 | 0.38 |
| Ultraviolet absorbent U-7 | 0.13 |
| Compound Cpd-M | 0.07 |
| Gelatin | 1.40 |
| 14th layer: 2nd protective layer | |
| Gelatin | 0.97 |
| Silver bromide Lippman emulsion | silver 0.12 |
| Yellow colloidal silver | silver 0.003 |
| Gelatin hardener H-2 | 0.31 |

The compounds added in the preparation of the sample 301 except for those described above were as follows.

| | |
|---|---|
| Cpd-M | N'-(2-(4-(hydroxyphenylsulfonyl)phenoxy)-dodecanoyl)-N-(4-(2-pentyloxy)phenyl)hydrazine |
| D-6 | 1,3-bis((1-(4-carboxylphenyl)-3-methyl-2-pyrazolin-5-one(4))trimethineoxonol |
| D-7 | 4-(4-(butanesulfonamidophenyl)-3-cyano-5-furfurylidene-2,5-dihydro-2-furanone |
| U-6 | 2-(2H-benzotriazol-2-yl)-4,6-bis(1,1-dimethylpropylphenol) |
| U-7 | 3-(di-n-dihexylamino)allylidenemalononitrile |
| H-2 | Bis(vinylsulfonyl)methane |

The silver iodobromide emulsions used in the sample 301 are shown in Table 8 below.

TABLE 8

| Emulsion name | Grain shape | AgI content (mol %) | Average equivalent-circle diameter (mm) | Average thickness (mm) | Aspect ratio | Ratio (%) of projected area of tabular grains | Variation coefficient (%) | Sensitizing dyes used |
|---|---|---|---|---|---|---|---|---|
| a | Tabular | 3.5 | 0.8 | 0.160 | 5.0 | 98 | 8.0 | S-2/S-3 |
| b | Tabular | 2.0 | 1.8 | 0.180 | 10.0 | 100 | 4.5 | " |
| c | Tabular | 3.5 | 1.0 | 0.118 | 8.5 | 100 | 5.0 | S-4/S-5 |
| d | Tabular | 1.5 | 2.0 | 0.133 | 15.0 | 99 | 5.0 | " |
| e | Tabular | 3.5 | 1.2 | 0.099 | 12.1 | 98 | 6.0 | S-6/S-7 |
| f | Tabular | 1.5 | 3.0 | 0.150 | 20.0 | 100 | 5.0 | " |

Samples 302 to 305 were made following the same procedures as for the sample 301 except that the emulsions 2 to 5 described in Example 1 were used in place of the emulsion 1 used in the 8th high-speed green-sensitive layer in the manufacture of the sample 301.

The samples 301 to 305 thus obtained were tested following the same procedures as in Example 2, thereby checking the emulsion performance of the 8th layer on the basis of an exposure amount by which a density greater by 2.0 than the magenta density was given. The result was similar to that obtained in Example 2.

EXAMPLE 4

Samples 401 to 405 were made following the same procedures as for the light-sensitive material 1 of Example 1 described in JP-A-2-93641 except that a silver iodobromide emulsion in the 13th layer was replaced with the emulsions 1 to 5 described in Example 1 of the present invention. When these samples were processed in the same manner as in Example 1 of JP-A-2-93641, the results similar to those in the Examples of the present invention were obtained.

What is claimed is:

1. A light-sensitive silver iodobromide emulsion comprising tabular silver iodobromide grains having twin planes, where the number of said twin planes is two, said grains having an equivalent-circle diameter/thickness ratio of 8 to 100, wherein a variation coefficient of a grain size distribution of said tabular silver iodobromide grains is 1% to 20%, and not less than 50% by number of all of said tabular silver iodobromide grains are grains whose ratio, b/a, of a distance, a, between said two twin planes of said tabular silver iodobromide grain to a grain thickness, b, is $1.5 \leqq b/a < 5$.

2. The emulsion according to claim 1, containing a polyethylene oxide block copolymer.

3. The emulsion according to claim 2, wherein a variation coefficient of a grain size distribution of said tabular silver iodobromide grains is 1% to 10%, tabular grains having the ratio, b/a, of 1.5 to less than 5 occupy 70% by number or more of all tabular grains, and the thickness, b, is 0.05 to 0.3 μm.

4. The emulsion according to claim 1, wherein a variation coefficient of a grain size distribution of said tabular silver iodobromide grains is 1% to 10%.

5. The emulsion according to claim 1, wherein tabular grains having the ratio, b/a, of 1.5 to less than 5 occupy 70% by number or more of all tabular grains.

6. The emulsion according to claim 1, wherein the thickness, b, is 0.05 to 0.3 μm.

7. A photographic light-sensitive material having at least one silver halide emulsion layer on a support, comprising at least one emulsion layer consisting of an emulsion of claim 1.

8. The material according to claim 7, containing a polyethylene oxide block copolymer.

9. A light-sensitive silver iodobromide emulsion comprising tabular silver iodobromide grains consisting of two twin planes, said grains having an equivalent-circle diameter/thickness ratio of 8 to 100, wherein a variation coefficient of a grain size distribution of said tabular silver iodobromide grains is 1% to 20%, and not less than 50% by number of all of said tabular silver iodobromide grains are grains whose ratio, b/a, of a distance, a, between said two twin planes of said tabular silver iodobromide grain to a grain thickness, b, is $1.5 \leqq b/a < 5$.

* * * * *